US011336007B1

(12) United States Patent
Graf et al.

(10) Patent No.: US 11,336,007 B1
(45) Date of Patent: May 17, 2022

(54) MULTI-BAND INTEGRATED ANTENNA ARRAYS FOR VERTICAL LIFT AIRCRAFT

(71) Applicant: Rockwell Collins, Inc., Cedar Rapids, IA (US)

(72) Inventors: Joseph T. Graf, Center Point, IA (US); James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 17/144,623

(22) Filed: Jan. 8, 2021

(51) Int. Cl.

| | |
|---|---|
| ***H01Q 1/52*** | (2006.01) |
| ***H01Q 1/28*** | (2006.01) |
| ***H01Q 13/10*** | (2006.01) |
| ***H01Q 7/00*** | (2006.01) |
| *H01Q 21/30* | (2006.01) |

(52) U.S. Cl.
CPC ..... *H01Q 1/523* (2013.01); *H01Q 1/283* (2013.01); *H01Q 1/286* (2013.01); *H01Q 1/287* (2013.01); *H01Q 7/00* (2013.01); *H01Q 13/10* (2013.01); *H01Q 21/30* (2013.01)

(58) Field of Classification Search
CPC ..... H01Q 1/523; H01Q 1/283; H01Q 1/286; H01Q 1/287; H01Q 7/00; H01Q 13/10; H01Q 21/30
See application file for complete search history.

(56) References Cited

U.S. PATENT DOCUMENTS

| | | | | |
|---|---|---|---|---|
| 3,823,403 | A * | 7/1974 | Walter | H01Q 7/00 343/846 |
| 4,510,500 | A * | 4/1985 | Brune | H01Q 1/28 455/193.1 |
| 4,656,482 | A | 4/1987 | Peng | |
| 8,228,251 | B1 | 7/2012 | Behdad et al. | |
| 8,643,564 | B2 | 2/2014 | Shimayama et al. | |
| 9,147,936 | B1 | 9/2015 | Apostolos et al. | |
| 9,172,147 | B1 | 10/2015 | Manry, Jr. | |
| 9,368,879 | B1 | 6/2016 | Manry, Jr. | |
| 10,290,931 | B1 | 5/2019 | Judd | |
| 10,644,385 | B1 | 5/2020 | Greenwood et al. | |
| 2008/0169988 | A1 | 7/2008 | Deaett et al. | |
| 2011/0063190 | A1 | 3/2011 | Ho et al. | |
| 2018/0166781 | A1 | 6/2018 | Snyder et al. | |
| 2019/0341679 | A1 | 11/2019 | Ozdemir et al. | |
| 2020/0185830 | A1 | 6/2020 | West | |

FOREIGN PATENT DOCUMENTS

| | | | | |
|---|---|---|---|---|
| CN | 107785659 | A | 3/2018 | |
| CN | 110085975 | B | 2/2020 | |
| EP | 2816666 | A1 | 12/2014 | |
| GB | 766087 | A | 1/1957 | |
| GB | 1270219 | A | 4/1972 | |
| WO | WO-2019077794 | A1 * | 4/2019 | H01Q 1/38 |

* cited by examiner

*Primary Examiner* — Hoang V Nguyen
(74) *Attorney, Agent, or Firm* — Suiter Swantz pc llo

(57) ABSTRACT

A system of antennas, each having disparity operating frequencies, are incorporated into the same aircraft body panels. HF antennas define loops with large internal areas; additional higher frequency antennas are disposed within that large internal area. The higher frequency antennas are sufficiently different so as to prevent coupling. Antennas operating in the same frequency range, disposed on different parallel surfaces are operated in concert as a steerable array.

20 Claims, 10 Drawing Sheets

MULTI-BAND INTEGRATED ANTENNA ARRAYS FOR VERTICAL LIFT AIRCRAFT

BACKGROUND

In many applications, such as military applications, it is desirable to have multiple redundant options for beyond-line-of-sight communication. Traditionally, such communication is primarily via SATCOM and an alternative, high frequency (HF) near vertical incident skywave (NVIS) system capable of beyond-line-of-site communication via interaction with the ionosphere when SATCOM is unavailable. HF antennas are large and there is a critical need to eliminate drag and antenna count in limited real estate platforms, such as attack helicopters, and also augment beyond-line-of-sight communication capabilities for contested environments.

Some HF antennas may be incorporated into or closely integrated with the body panels of such platforms, but that incorporation consumes substantial surface area, leaving limited surface area to incorporate other, higher frequency antennas.

SUMMARY

In one aspect, embodiments of the inventive concepts disclosed herein are directed to a system of antennas, each having disparity operating frequencies, incorporated into the same aircraft body panels. HF antennas define loops with large internal areas; additional higher frequency antennas are disposed within that large internal area.

In a further aspect, antennas operating in the same frequency range, disposed on different parallel surfaces are operated in concert as a steerable array.

It is to be understood that both the foregoing general description and the following detailed description are exemplary and explanatory only and should not restrict the scope of the claims. The accompanying drawings, which are incorporated in and constitute a part of the specification, illustrate exemplary embodiments of the inventive concepts disclosed herein and together with the general description, serve to explain the principles.

BRIEF DESCRIPTION OF THE DRAWINGS

The numerous advantages of the embodiments of the inventive concepts disclosed herein may be better understood by those skilled in the art by reference to the accompanying figures in which.

DETAILED DESCRIPTION

Figure 1:
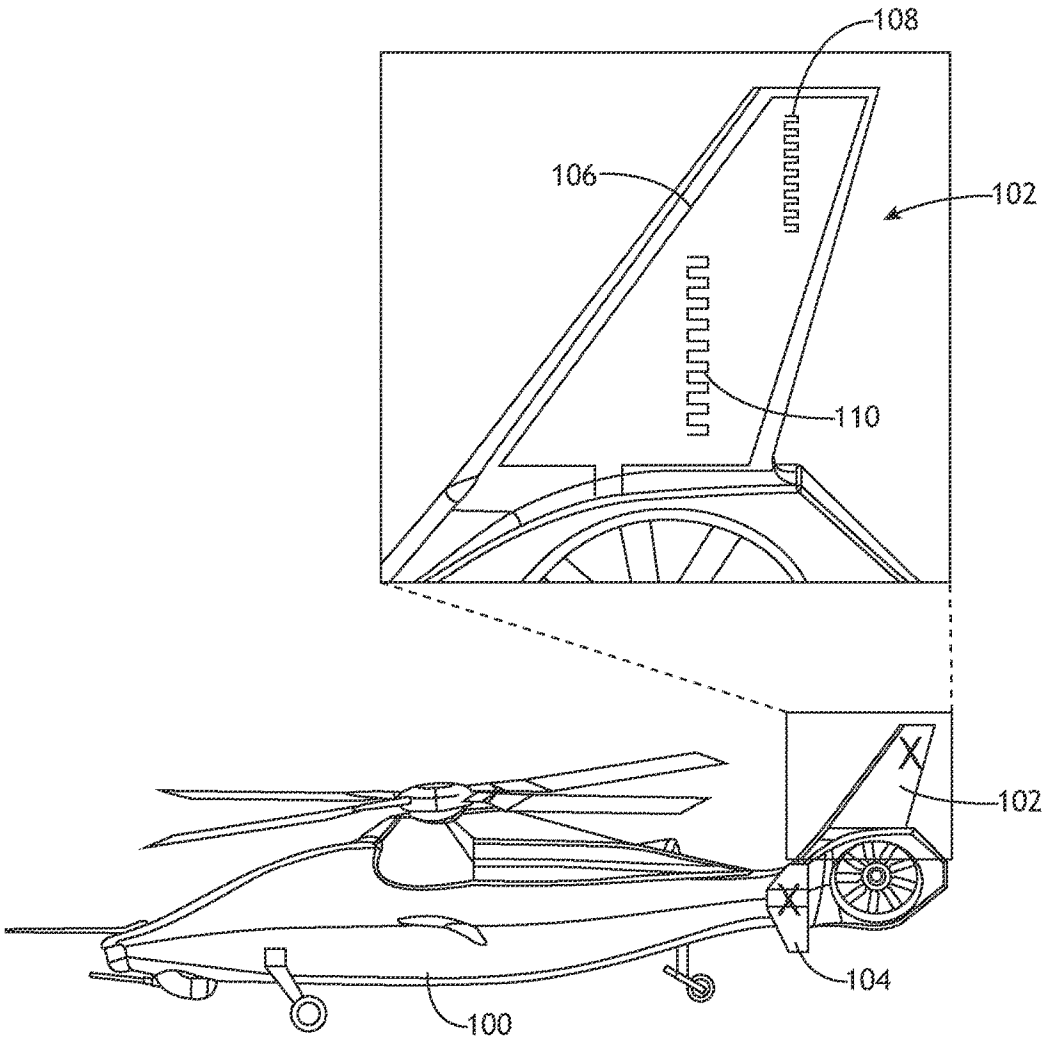
FIG. 1 shows a side environmental view of embedded antennas according to an exemplary embodiment.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1a, 1b). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to a system of antennas, each having disparity operating frequencies, incorporated into the same aircraft body panels. HF antennas define loops with large internal areas; additional higher frequency antennas are disposed within that large internal area. Antennas operating in the same frequency range, disposed on different parallel surfaces are operated in concert as a steerable array.

Referring to FIG. 1, a side environmental view of embedded antennas according to an exemplary embodiment is shown. An aircraft 100 having a plurality of body panels 102, 104 defining substantially parallel surfaces of the aircraft 100. In at least one embodiment, the aircraft 100 may operate multiple data communication systems, each requiring an antenna 106, 108, 110 configured for operating in a specific frequency range. An HF antenna 106 may be disposed in or on a body panel 102, 104 for HF specific functions such NVIS; such HF antennas 106 are generally large and may define a large space in the corresponding body panel 102, 104. Within the large space, higher frequency antennas 108, 110 are disposed; for example, very-high frequency (VHF) antennas 106 and ultra-high frequency (UHF) antennas 110 may be disposed in the space. VHF antennas 108 and UHF antennas 110 are unlikely to cause coupling that would interfere with the function of the HF antenna 106 or each other, therefore close proximity in the same body panel 102, 104 is not a hinderance. It may be appreciated that in some cases, antennas 106, 108, 110 may have operating frequencies that are likely to cause coupling; such combinations of antennas 106, 108, 110 would not be optimal, but may be possible where on-board systems could insure that antennas 106, 108, 110 on the same body panel 102, 104 would not be operated simultaneously.

Figure 2:
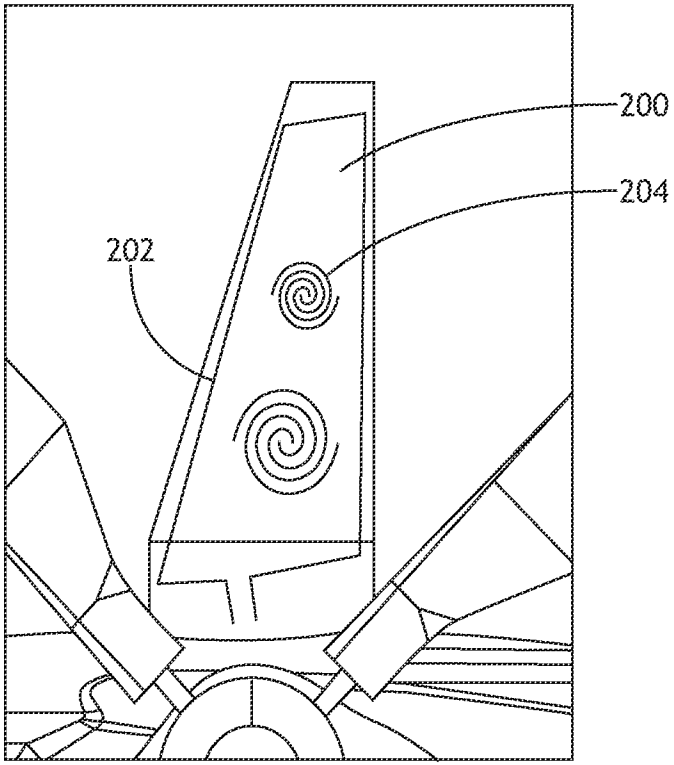
FIG. 2 shows a top view of a body panel with embedded antennas according to an exemplary embodiment.

Referring to FIG. 2, a top view of a body panel with embedded antennas according to an exemplary embodiment is shown. In at last one embodiment, horizontal aircraft surfaces 200 may include an HF antenna 202 encompassing a large area, and one or more spiral antennas 204 disposed within the large area. The spiral antennas 204 may be slot or printed material antennas, or cavity backed for unidirectional communication. In at least one embodiment, a slot spiral antenna 204 that is not cavity backed may be configured for bi-directional communication; in the case of a horizontal surface, both upward and downward.

In at least one embodiment, spiral antennas 204 disposed in or on parallel surfaces may be operated in concert as an array for beam steering.

Figure 3:
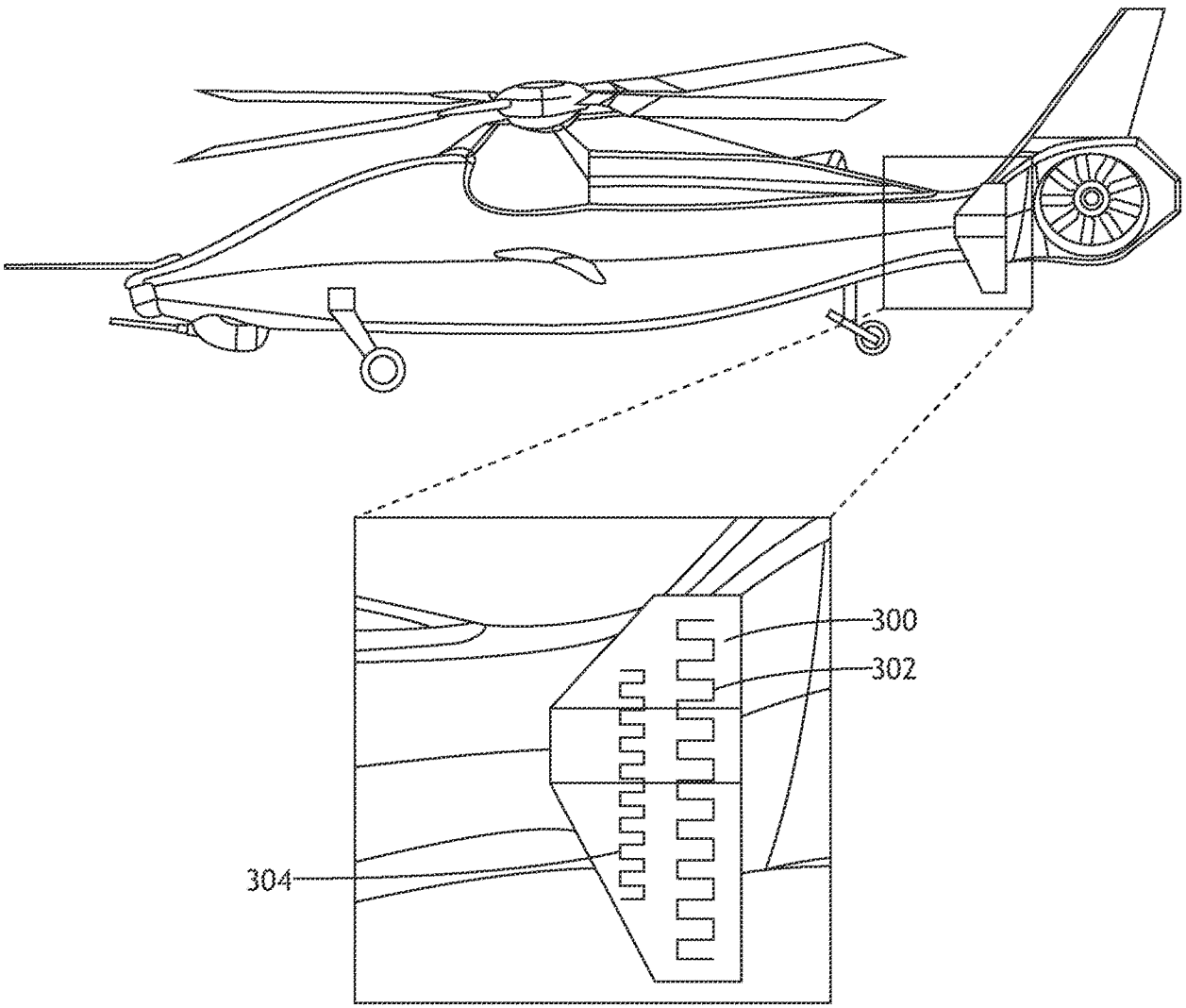
FIG. 3 shows a side environmental view of embedded antennas according to an exemplary embodiment.

Referring to FIG. 3, a side environmental view of embedded antennas 302, 304 according to an exemplary embodiment is shown. In at least one embodiment, vertical surfaces 300 are embedded with a plurality of antennas 302, 304 configured to operate in disparate frequency ranges. In at least one embodiment, antennas 302, 304 configured for a specific frequency range disposed on a surface 300 may operate in concert with other antennas 302, 304 on that surface and other parallel surfaces as an array to allow for beam steering.

In at least one embodiment, the vertical surfaces 300 comprise small vertical stabilizers of an aircraft. A first set of antennas 302 may be configured for VHF operation while a second set of antennas 304 may be configured for UHF operation. Each of the VHF antennas 302 and UHF antennas 304 may be loop antennas, meandered dipole antennas, slot antennas, bi-directional spiral antennas, etc., or some combination thereof.

Figure 4:
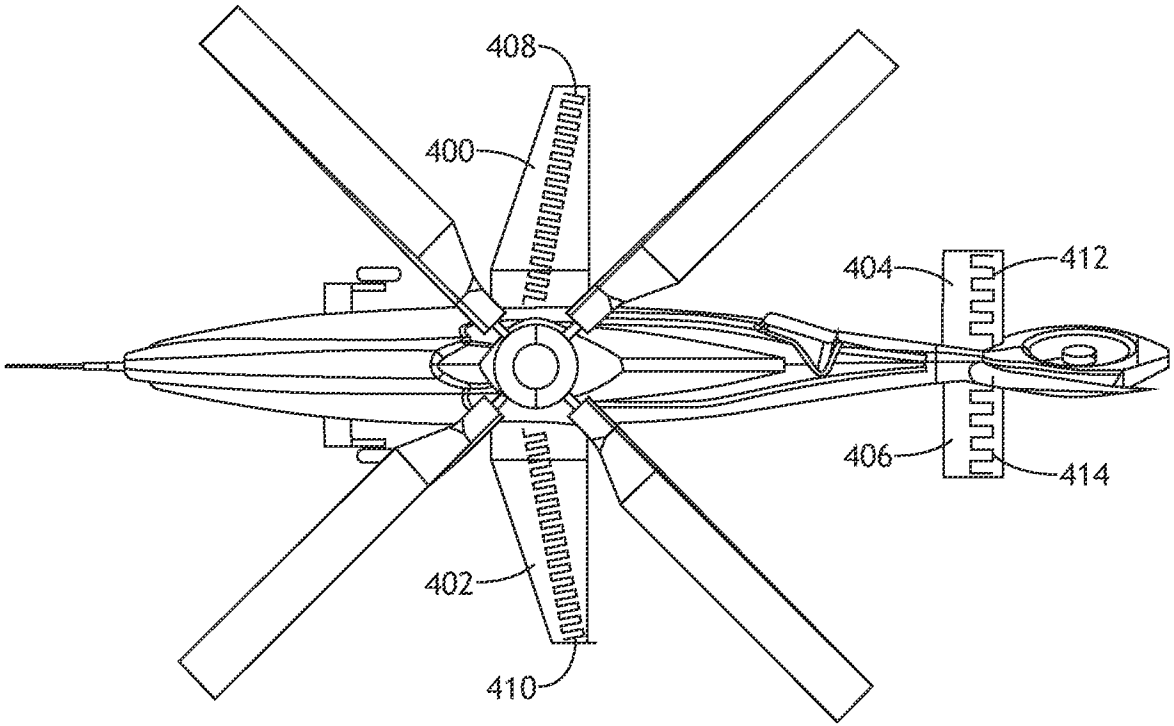
FIG. 4 shows a top environmental view of embedded antennas according to an exemplary embodiment.
Figure 5B:
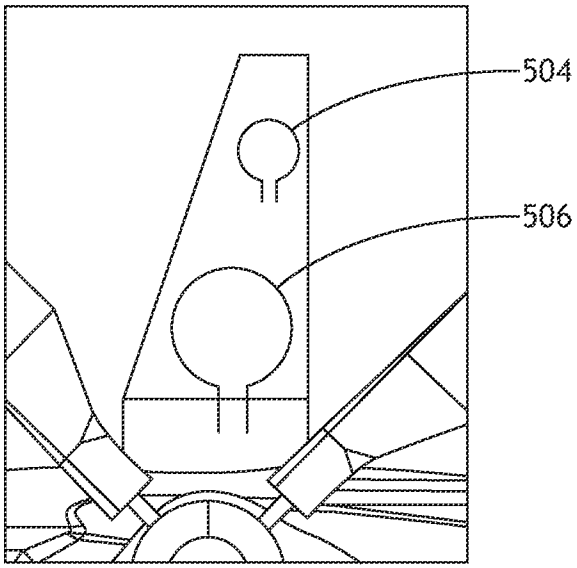
FIG. 5B shows a top view of a body panel with embedded antennas according to an exemplary embodiment.
Figure 5A:
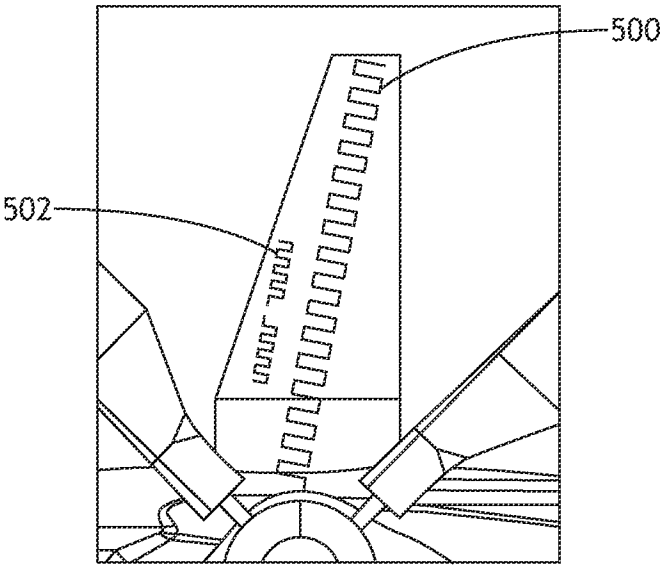
FIG. 5A shows a top view of a body panel with embedded antennas according to an exemplary embodiment.
Figure 5D:
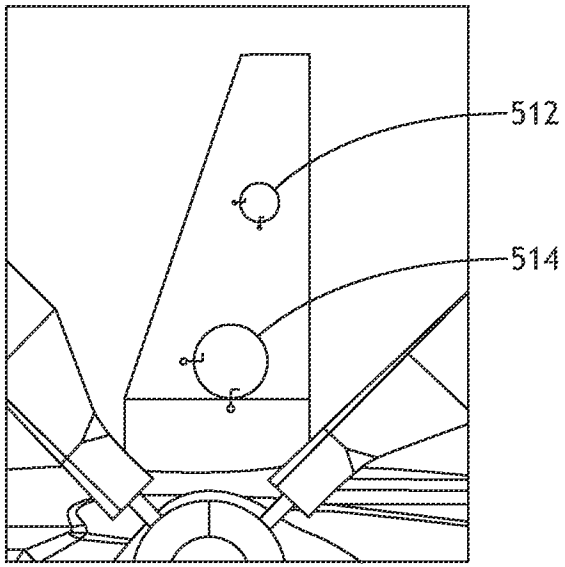
FIG. 5D shows a top view of a body panel with embedded antennas according to an exemplary embodiment.
Figure 5C:
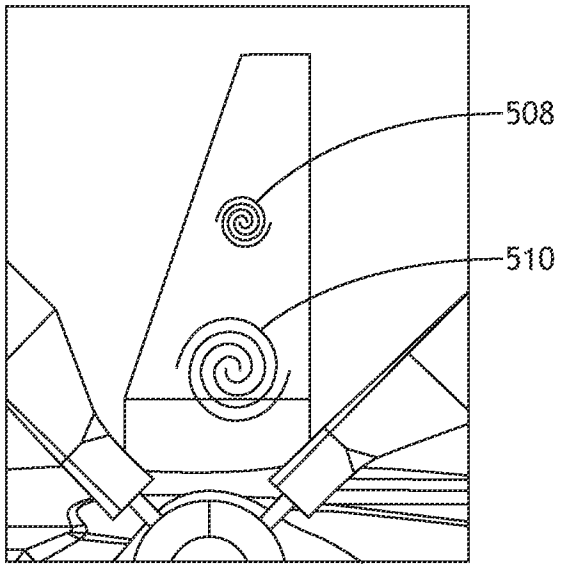
FIG. 5C shows a top view of a body panel with embedded antennas according to an exemplary embodiment.

Referring to FIG. 4, a top environmental view of embedded antennas 408, 410, 412, 414 according to an exemplary embodiment is shown. In at least one embodiment, aircraft surfaces 400, 402, 404, 406 may be dedicated to specific set of antennas 408, 410, 412, 414 to minimize mutual coupling.

Referring to FIGS. 5A-5D, top views of body panels with embedded antennas according to an exemplary embodiment are shown. In at least one embodiment, such as in FIG. 5A, meandered dipole antennas 500, 502 configured to operate in different frequency ranges are disposed in or on a horizontal surface for horizontal polarization; for example, a first set of antennas 500 may be configured for VHF frequencies with a horizontal polarization while a second set of antennas 502 may be configured for UHF frequencies with a horizontal polarization. In at least one embodiment, such as in FIG. 5B, loop antennas 504, 506 are configured to operate in VHF and UHF frequency ranges with vertical polarization. In at least one embodiment, such as in FIG. 5C, bi-directional spiral antennas 508, 510 are configured to operate in VHF and UHF frequency ranges with vertical polarization. In at least one embodiment, such as in FIG. 5D, annular slot antennas 512, 514 are configured to operate in VHF and UHF frequency ranges with vertical polarization. In at least one embodiment, annular slot antennas 512, 514 may have a ground and produce unidirectional radiation patterns. Alternatively, annular slot antennas 512, 514 may have no ground and produce bi-directional radiation patterns.

Figure 6:
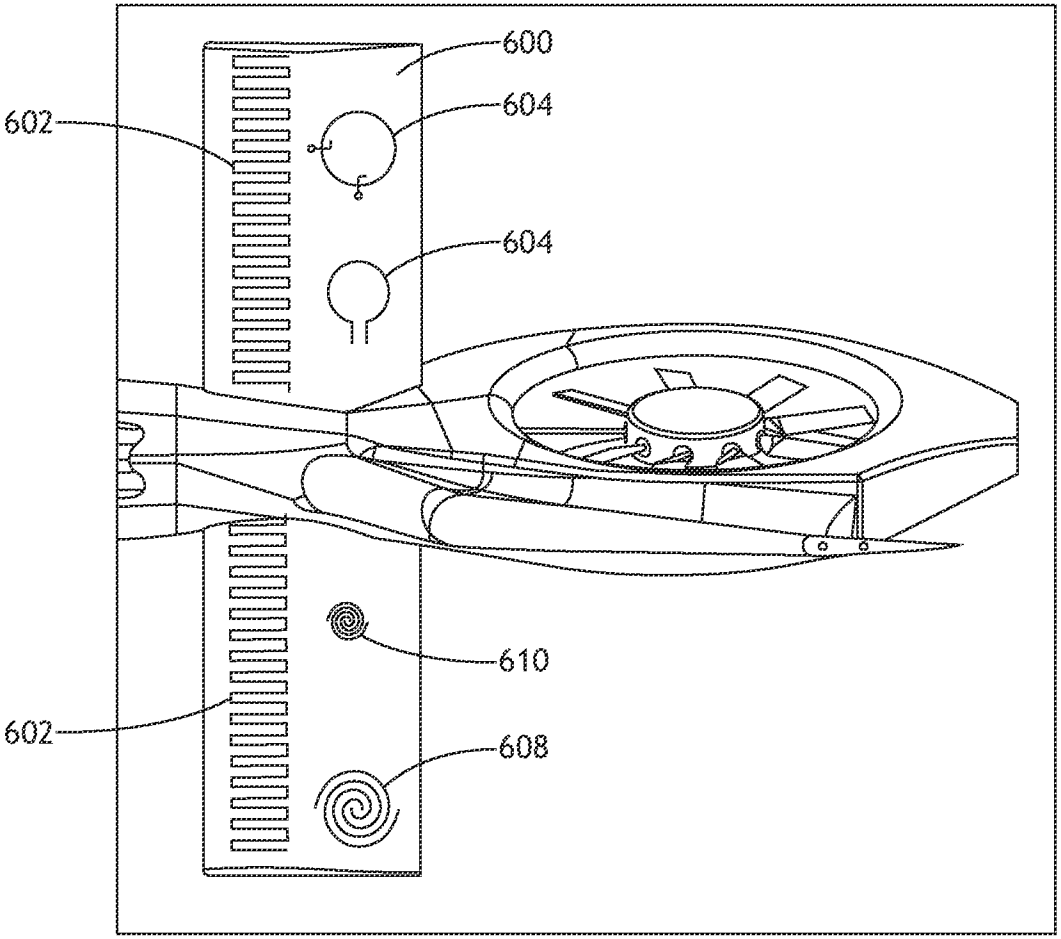
FIG. 6 shows a top view of body panels with embedded antennas according to an exemplary embodiment.

Referring to FIG. 6, a top view of body panels with tandem embedded antennas according to an exemplary embodiment is shown. Different classes of antennas 602, 604, 606, 608, 610 may be disposed in substantially parallel surfaces 600. In at least one embodiment, a first class of antenna elements 602 may be disposed across a plurality of substantially parallel surfaces 600 with a common differential feed network to apply signals to the first class of antenna elements 602 and operate them as an array. The first class of antenna elements 602 are configured for horizontal polarization and may be fed in the center and the axial area of the fuselage. The first class of antenna elements 602 may be HF, but meandering line dipoles can also be of higher frequency.

In at least one embodiment, switchable line length modulation may be employed to operate the first class of antenna elements 602 for NVIS tuning. Furthermore, a second class of antenna elements 604 (for example annular slot elements) may be disposed on one of the substantially parallel surfaces 600. The second class of antenna elements 604 may comprise UHF antennas 604 configured for vertical polarization; furthermore, a third class of antenna elements 606 (for example loop antenna elements) may also be disposed on the same substantially parallel surface 600, configured for UHF but vertical polarization.

In at least one embodiment, a fourth class of antenna elements 608, 610 are disposed on a different substantially parallel surface. The fourth class of antenna elements (for example bi-directional spiral elements) may be configured for operation in different frequency ranges; for example, the fourth set may include VHF bi-directional spiral antenna elements 608 and UHF bi-directional spiral antenna elements 610, each configured for vertical polarization. In at least one embodiment, spiral antenna elements 608, 610 are configured for ultra-wideband communication.

Figure 7A:
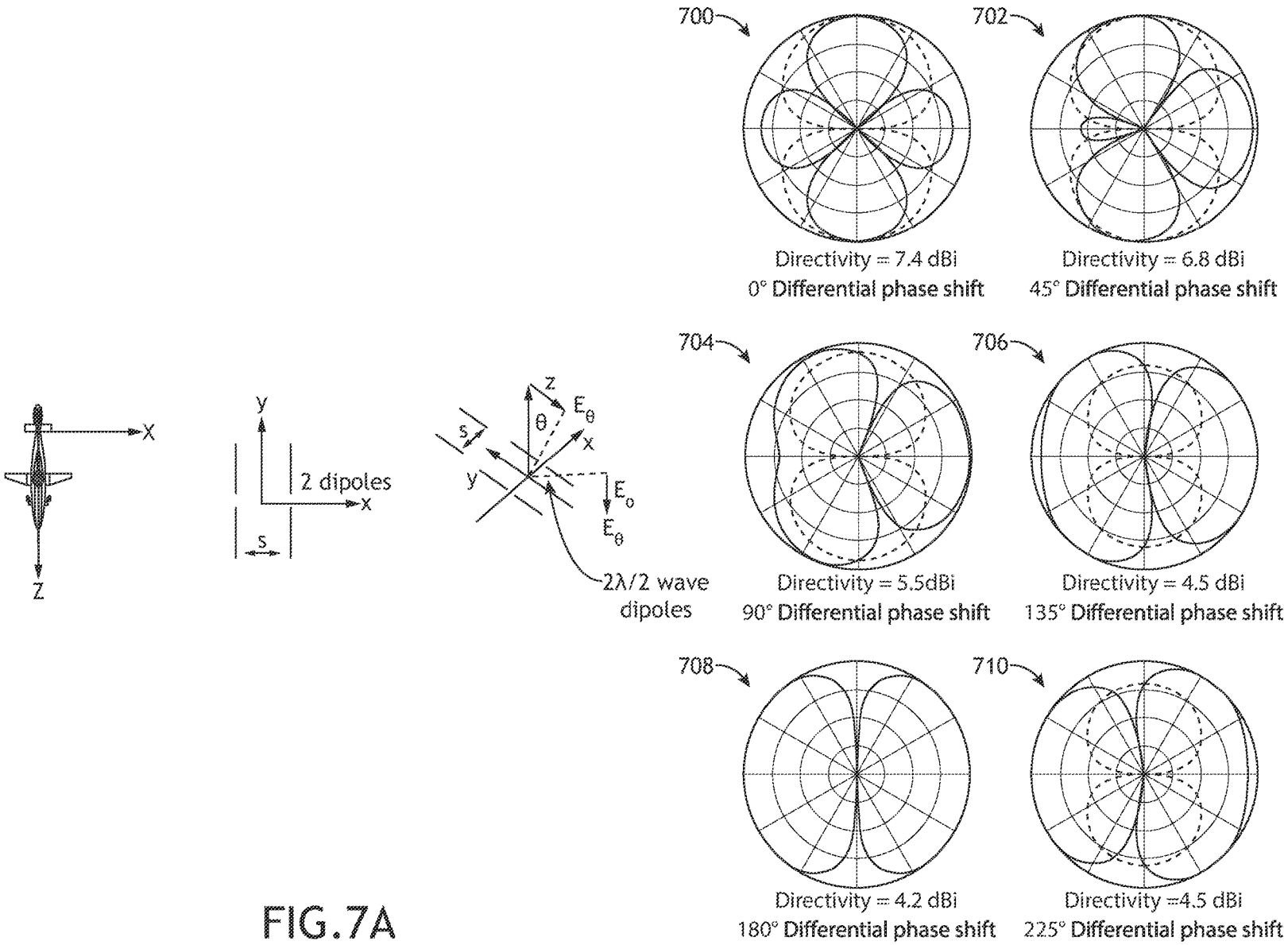
FIG. 7A shows diagrams of radiation patterns produced limited element arrays disposed on aircraft panels according to an exemplary embodiment.
Figure 7B:
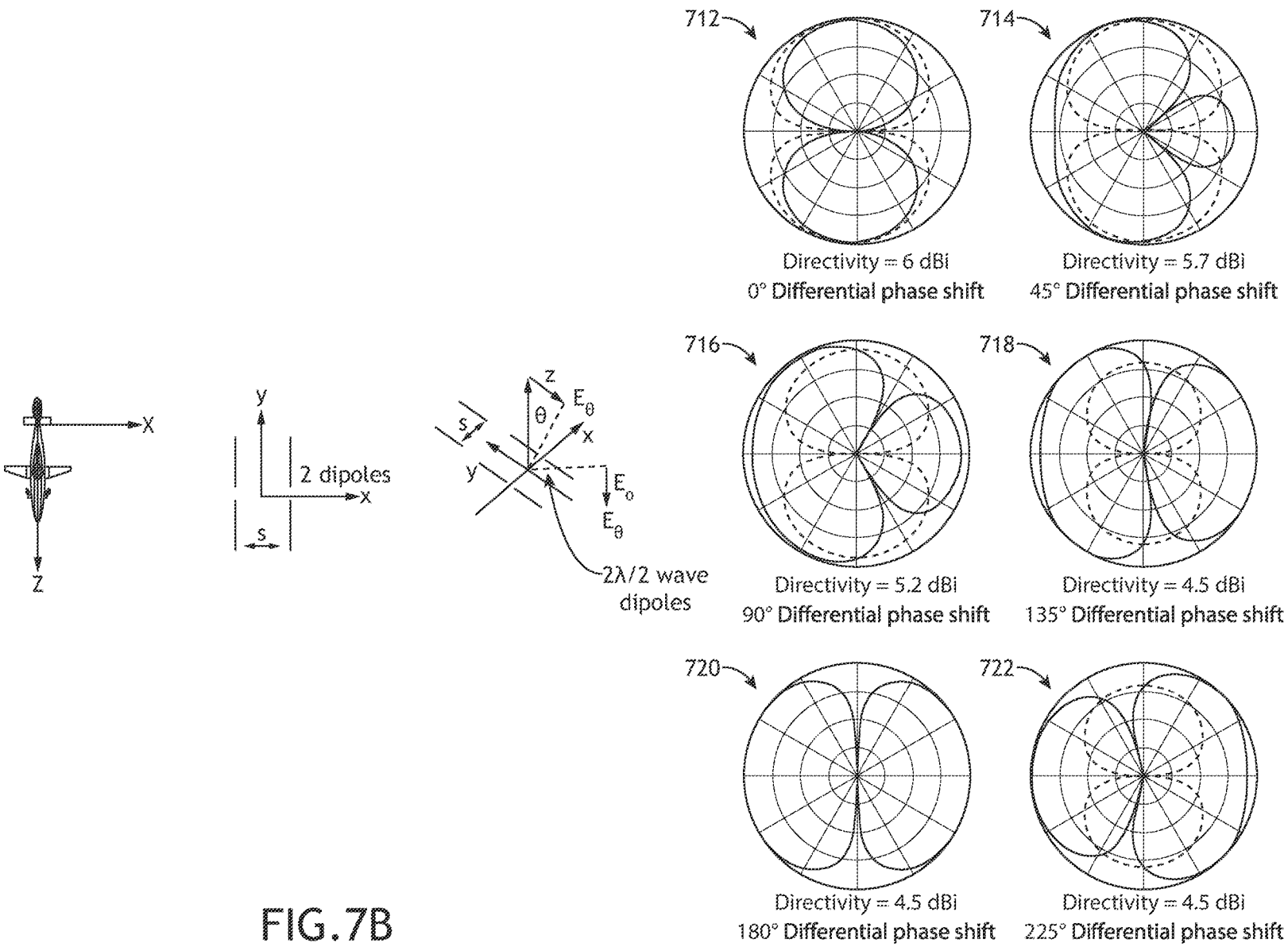
FIG. 7B shows diagrams of radiation patterns produced limited element arrays disposed on aircraft panels according to an exemplary embodiment.
Figure 7C:
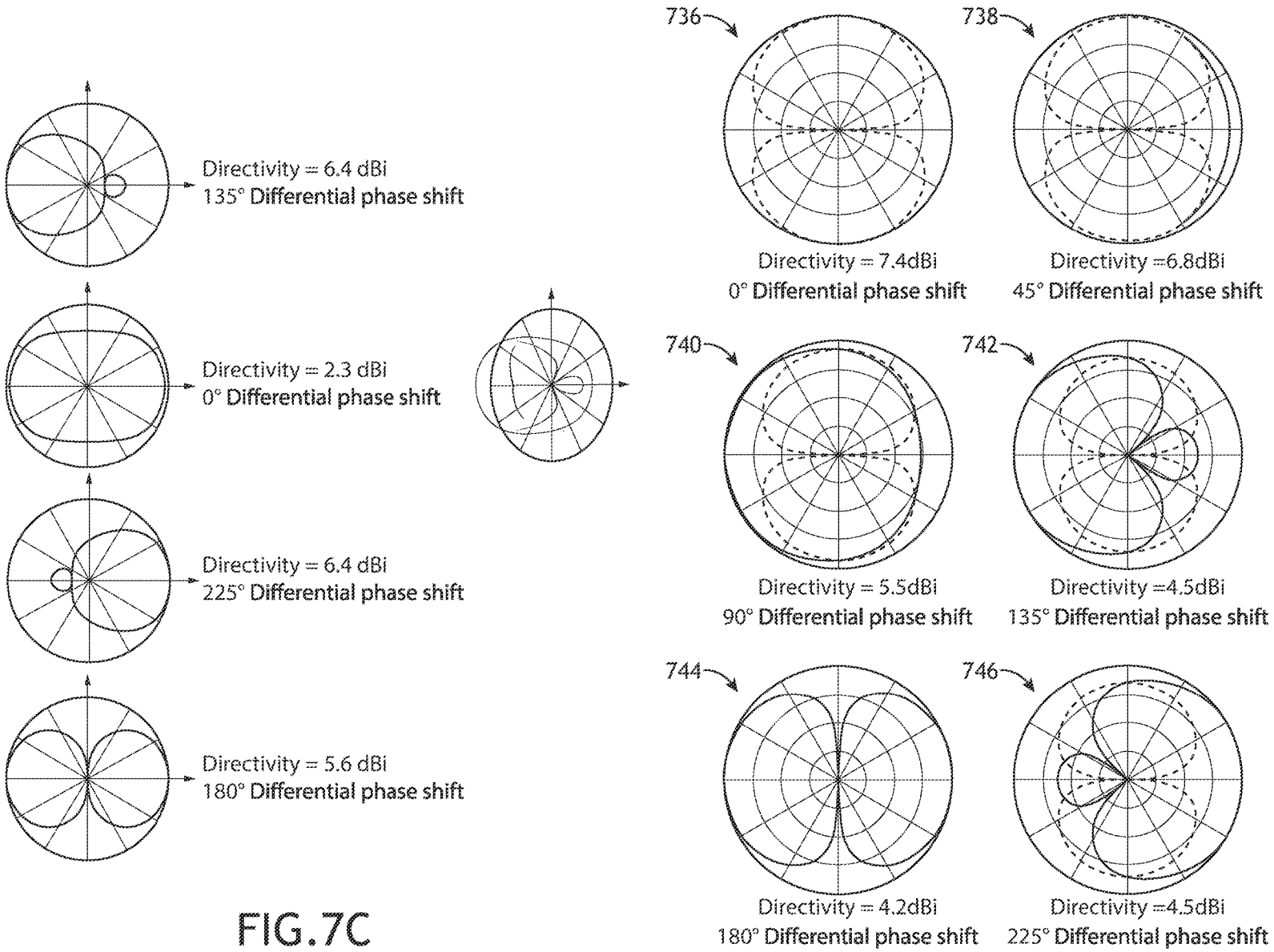
FIG. 7C shows diagrams of radiation patterns produced limited element arrays disposed on aircraft panels according to an exemplary embodiment.

Referring to FIGS. 7A-7C, diagrams of radiation patterns produced limited element arrays disposed on aircraft panels according to an exemplary embodiment are shown. Where an aircraft includes two disparate antennas incorporated into certain substantially parallel body panels operated as an array, the array may be operated in a frequency range of about 400 MHz (as in FIG. 7A). Where the antennas are spaced approximately 50 cm apart, the antennas may produce a beam 700 with 7.4 dBi of directivity at 0° of differential phase shift; a beam 702 with 6.8 dBi of directivity at 45° of differential phase shift; a beam 704 with 5.5 dBi of directivity at 90° of differential phase shift; a beam 706 with 4.5 dBi of directivity at 135° of differential phase shift; a beam 708 with 4.2 dBi of directivity at 180° of differential phase shift; and a beam 710 with 4.5 dBi of directivity at 225° of differential phase shift (flipped as compared to the beam 706 at) 135°. Likewise and alternatively, the array may be operated in a frequency range of about 300 MHz (as in FIG. 7B). Where the antennas are spaced approximately 50 cm apart, the antennas may produce a beam 712 with 6 dBi of directivity at 0° of differential phase shift; a beam 714 with 5.7 dBi of directivity at 45° of differential phase shift; a beam 716 with 5.2 dBi of directivity at 90° of differential phase shift; a beam 718 with 4.5 dBi of directivity at 135° of differential phase shift; a beam 720 with 4.5 dBi of directivity at 180° of differential phase shift; and a beam 722 with 4.5 dBi of directivity at 225° of differential phase shift (flipped as compared to the beam 718 at 135°). Likewise and alternatively, the array may be operated in a frequency range of about 100 MHz (as in FIG. 7C). Where the antennas are spaced approximately 50 cm apart, the antennas may produce a beam 736 with 2.3 dBi of directivity at 0° of differential phase shift; a beam 738 with 2.9 dBi of directivity at 45° of differential phase shift; a beam 740 with 4.5 dBi of directivity at 90° of differential phase shift; a beam 742 with 6.4 dBi of directivity at 135° of differential phase shift; a beam 744 with 5.6 dBi of directivity at 180° of differential phase shift; and a beam 746 with 6.4 dBi of directivity at 225° of differential phase shift (flipped as compared to the beam 718 at 135°). The limited arrays shown in FIGS. 7A-7C allow for modest beam directionality and nulling capability.

It may be appreciated that, while one specific UHF application is described with respect to FIG. 7, the concept may be generalized to other embodiments, e.g., DF phase based interferometers, etc.

Historically electronic warfare systems have been segregated from comm systems, which exacerbate the antenna count and SWAP-C problems associated with limited real available area and low aerodynamic drag requirement of airborne platforms. Embodiments of the present disclosure enable integrated comm, electronic warfare, and radar applications such as foliage penetration.

It is believed that the inventive concepts disclosed herein and many of their attendant advantages will be understood by the foregoing description of embodiments of the inventive concepts disclosed, and it will be apparent that various changes may be made in the form, construction, and arrangement of the components thereof without departing from the broad scope of the inventive concepts disclosed herein or without sacrificing all of their material advantages; and individual features from various embodiments may be combined to arrive at other embodiments. The form herein before described being merely an explanatory embodiment thereof, it is the intention of the following claims to encompass and include such changes. Furthermore, any of the features disclosed in relation to any of the individual embodiments may be incorporated into any other embodiment.

What is claimed is:

1. An aircraft antenna system comprising:

at least one high-frequency (HF) antenna loop defining an internal area; and at least one secondary antenna disposed within the internal area, wherein:

the at least one secondary antenna is configured to operate in a frequency range that will not produce mutual coupling with the at least one HF antenna.

2. The aircraft antenna system of claim 1, wherein the at least one secondary antenna comprises at least one antenna configured to operate in a very-high frequency (VHF) range.

3. The aircraft antenna system of claim 2, wherein the at least one secondary antenna further comprises at least one antenna configured to operate in an ultra-high frequency (UHF) range.

4. The aircraft antenna system of claim 1, wherein:

the at least one HF antenna loop comprises at least two HF antenna loops, each disposed on separate, parallel surfaces; and the at least one secondary antenna comprises at least two secondary antennas, each disposed within the internal area of a separate corresponding HF antenna loop.

5. The aircraft antenna system of claim 4, further comprising at least one processor in data communication with the HF antenna loops and secondary antennas, and a memory storing non-transitory processor executable code configuring the at least one processor to independently apply signals to the secondary antennas, wherein the signals are configured to apply differently phased signals to produce a steerable beam via the secondary antennas.

6. The aircraft antenna system of claim 1, wherein the at least one secondary antenna comprises a meandered dipole antenna.

7. The aircraft antenna system of claim 1, wherein the at least one secondary antenna comprises a dipole loop antenna.

8. The aircraft antenna system of claim 1, wherein the at least one secondary antenna comprises a bi-directional spiral antenna.

9. The aircraft antenna system of claim 1, wherein the at least one secondary antenna comprises an annular slot antenna.

10. An aircraft body panel comprising:

at least one high-frequency (HF) antenna loop defining an internal area; and at least one secondary antenna disposed within the internal area, wherein:

the at least one secondary antenna is configured to operate in a frequency range that will not produce mutual coupling with the at least one HF antenna.

11. The aircraft body panel of claim 10, wherein the at least one secondary antenna comprises at least one antenna configured to operate in a very-high frequency (VHF) range.

12. The aircraft body panel of claim 11, wherein the at least one secondary antenna further comprises at least one antenna configured to operate in an ultra-high frequency (UHF) range.

13. The aircraft body panel of claim 10, wherein the at least one secondary antenna comprises a meandered dipole antenna.

14. The aircraft body panel of claim 10, wherein the at least one secondary antenna comprises a dipole loop antenna.

15. The aircraft body panel of claim 10, wherein the at least one secondary antenna comprises a bi-directional spiral antenna.

16. The aircraft body panel of claim 10, wherein the at least one secondary antenna comprises an annular slot antenna.

17. A system of antennas comprising:

at least two high-frequency (HF) antenna loops, each defining an internal area and each disposed on separate, parallel surfaces;

a plurality of secondary antennas, each disposed within the internal area of one of the HF antenna loops; and at least one processor in data communication with the HF antenna loops and secondary antennas, and a memory storing non-transitory processor executable code, wherein:

each secondary antenna in the plurality of secondary antennas is configured to operate in a frequency range that will not produce mutual coupling with the at least one HF antenna; and the at least one processor is configured to independently apply signals to the secondary antennas, wherein the signals are configured to apply differently phased signals to produce a steerable beam via the secondary antennas.

18. The system of antennas of claim 17, wherein the plurality of secondary antennas comprises:

at least one antenna configured to operate in a very-high frequency (VHF) range; and at least one antenna configured to operate in an ultra-high frequency (UHF) range.

19. The system of antennas of claim 17, wherein the at least one secondary antenna comprises a meandered dipole antenna.

20. The system of antennas of claim 17, wherein the at least one secondary antenna comprises a dipole loop antenna.

* * * * *